US006804836B2

(12) United States Patent
Grilliot et al.

(10) Patent No.: US 6,804,836 B2
(45) Date of Patent: Oct. 19, 2004

(54) SHEET WITH GROMMET TO PROVIDE FLUID-IMPERVIOUS SEAL AROUND OBJECT PENETRATING SHEET

(75) Inventors: William L. Grilliot, Dayton, OH (US); Mary I. Grilliot, Dayton, OH (US)

(73) Assignee: Morning Pride Manufacturing, L.L.C., Dayton, OH (US)

( * ) Notice: Subject to any disclaimer, the term of this patent is extended or adjusted under 35 U.S.C. 154(b) by 132 days.

(21) Appl. No.: 10/151,390

(22) Filed: May 20, 2002

(65) Prior Publication Data

US 2003/0221247 A1 Dec. 4, 2003

(51) Int. Cl.[7] ..... A41D 13/00; A62B 17/00

(52) U.S. Cl. ..... 2/455; 2/457; 2/87; 2/171.3; 2/171.5; 2/901

(58) Field of Search ..... 2/455, 456, 457, 2/84, 171.3, 171.5, 901

(56) References Cited

U.S. PATENT DOCUMENTS 4,272,851 A 6/1981 Goldstein
4,864,654 A 9/1989 Schriver et al.
4,986,805 A * 1/1991 Laramore ..... 493/199
5,421,326 A * 6/1995 Rankin et al. ..... 128/201.19
5,659,924 A * 8/1997 Gildersleeve ..... 16/2.1
5,976,643 A * 11/1999 Sallee ..... 428/17
6,119,305 A * 9/2000 Loveall et al. ..... 16/2.2
6,237,596 B1 * 5/2001 Bohmfalk ..... 128/206.22
6,349,412 B1 * 2/2002 Dean ..... 2/102
6,349,721 B1 * 2/2002 Grilliot et al. ..... 128/201.29
6,364,980 B1 4/2002 Smith et al.
6,561,191 B1 * 5/2003 Kwok ..... 128/207.12

* cited by examiner

*Primary Examiner*—John J. Calvert
*Assistant Examiner*—Robert H. Muromoto, Jr.
(74) *Attorney, Agent, or Firm*—Wood, Phillips, Katz, Clark & Mortimer

(57) ABSTRACT

A fluid-impervious sheet has two expansive surfaces, to one of which an elastomeric grommet adheres. The elastomeric grommet, which is annular when unstressed, outlines a region on the fluid-impervious sheet. The elastic grommet is adapted to provide a fluid-impervious seal around an object penetrating the region outlined by the elastomeric grommet and fitting tightly through the elastomeric grommet. A protective garment for a hazardous environment is made from the fluid-impervious sheet and has a breathing apparatus, which comprises elements inside the protective garment, elements outside the protective garment, and a tube connecting the inside and outside elements. The tube penetrates the region outlined by the elastomeric grommet and fits tightly through the elastomeric grommet, which provides a fluid-impervious seal around the tube.

3 Claims, 2 Drawing Sheets

SHEET WITH GROMMET TO PROVIDE FLUID-IMPERVIOUS SEAL AROUND OBJECT PENETRATING SHEET

TECHNICAL FIELD OF THE INVENTION

Generally, this invention pertains to a sheet, which is fluid-impervious where not penetrated. This invention provides a grommet, which adheres to one expansive surface of the sheet, which may be an elastomeric grommet, and which is adapted to provide a fluid-tight seal around an object penetrating the sheet, in a region outlined by the elastomeric grommet. In a specific application, this invention pertains to a protective garment, which is made from such a sheet, for a firefighter, a rescue worker, a chemical worker, or another worker working in a hazardous environment.

BACKGROUND OF THE INVENTION

Commonly, when working in a hazardous environment, which may be oxygen-deficient or which may expose occupants to toxins, pathogens, or other hazards, a worker wears a protective garment, which is made from sheets of fluid-impervious films or from sheets of fluid-impervious fabrics. Such protective garments are exemplified in U.S. Pat. Nos. 4,272,851, 4,864,654, and 6,364,980, which disclose suitable films, fabrics, and laminates and the disclosures of which are incorporated herein by reference.

As exemplified in U.S. Pat. No. 4,864,654, it is known for a worker wearing a protective garment, as described above, to wear a self-contained breathing apparatus, which comprises an air bottle, among other elements, and all elements of which are worn within the protective garment. Various closures are provided, which enable the wearer to don the self-contained breathing apparatus, to doff it, and to change its air bottle.

SUMMARY OF THE INVENTION

This invention begins with a sheet, which is fluid-impervious where not penetrated, which may be made from any suitable film, fabric, or laminate, as discussed above, and which has two expansive surfaces. This invention provides a grommet, which adheres to one of the expansive surfaces of the sheet and which may be an elastomeric grommet made from neoprene or from any other, suitable, elastomeric material. The grommet, which outlines a region on the fluid-impervious sheet, is adapted to provide a fluid-impervious seal around an object penetrating the region outlined by the grommet and fitting tightly through the grommet. Preferably, the grommet is annular and, when flattened and before being penetrated, the region outlined by the grommet is circular.

This invention can be advantageously embodied in a protective garment, a portion of which is made from such a sheet, for a firefighter, a rescue worker, a chemical worker, or another worker working in a hazardous environment, which may be oxygen-deficient or which may expose occupants to toxins, pathogens, or other hazards, particularly but not exclusively if the protective garment is combined with a breathing or air-filtering apparatus comprising elements inside the protective garment, elements outside the protective garment, and a tube connecting the inside and outside elements. Thus, if the tube penetrates the region outlined by the grommet and fits tightly through the grommet, the grommet provides a fluid-impervious seal around the tube.

DETAILED DESCRIPTION OF THE ILLUSTRATED EMBODIMENT

Figure 1:
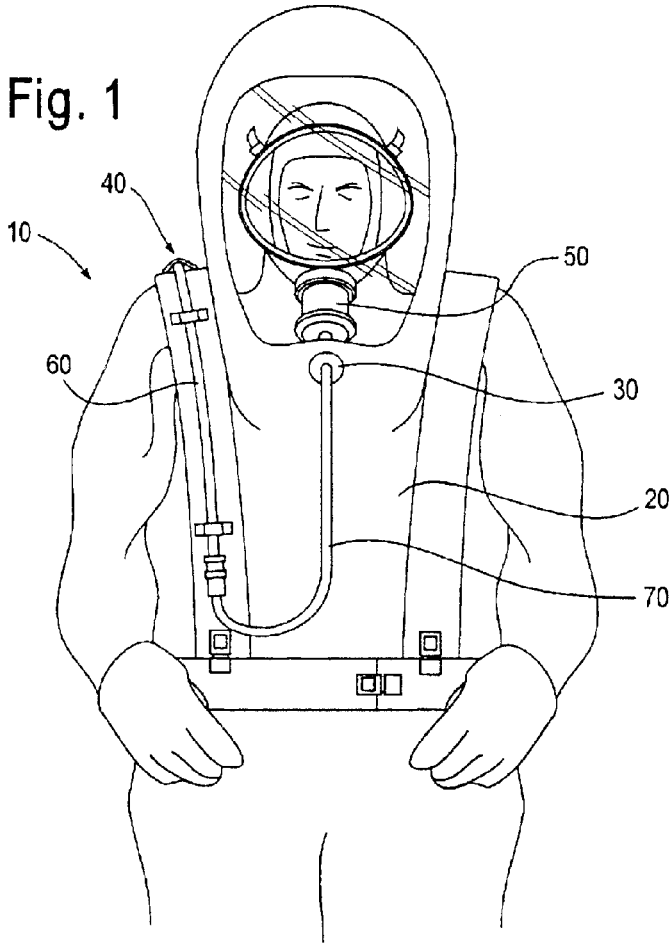
FIG. 1 is a fragmentary, perspective view of a worker wearing a protective garment, a portion of which is made from a sheet having an elastomeric grommet, as provided by this invention, and wearing a self-contained breathing apparatus comprising, among other elements, a flexible tube, around which the elastomeric grommet provides a fluid-impervious seal.

As illustrated in FIG. 1, a wearer is wearing a protective garment 10, a portion of which is made from a sheet 20 having an elastomeric grommet 30, as provided by this invention, and wearing a self-contained breathing apparatus 40, as contemplated by this invention.

The sheet 20, which is made from any suitable film, fabric, or laminate, as discussed above, such as a laminate of non-woven, spun-bonded olefin and polyethylene, e.g. TYVEK™ material, so as to be fluid-impervious where not penetrated. The sheet 20 has two expansive surfaces, i.e., an outer surface 22 and an inner surface 24. The elastomeric grommet 30, which is made from neoprene or any other, suitable, elastomeric material, adheres to the outer surface 22 of the sheet 20. The elastomeric grommet 30 is caused to adhere to the outer surface 22 of the sheet 20 adhesively, via heat bonding or chemical bonding, or in any other suitable manner considering materials used for the sheet 20 and for the elastomeric grommet 30. The elastomeric grommet 30, which is annular when unstressed, outlines a region 26 of the sheet 20. The outlined region 26, when flattened and before being penetrated, is circular.

The self-contained breathing apparatus 40, which per se is conventional, comprises an air bottle, which is not illustrated and which is slung over the wearer's back, outside the protective garment 10 when the protective garment 10 and the self-contained breathing apparatus 40 are worn together. Advantageously, because of this invention, the wearer is not required to wear the air bottle inside the protective garment 10.

The self-contained breathing apparatus 40 further comprises other elements 50, which are inside the protective garment 10 when the protective garment 10 and the self-contained breathing apparatus 40 are worn together. The self-contained breathing apparatus 40 further comprises other elements 60, which besides the air bottle are outside the protective garment 40 when the protective garment 10 and the self-contained breathing apparatus 40 are worn together. The self-contained breathing apparatus 40 further comprises a flexible tube 70, which connects the inside elements 50 and the outside elements 60 and which is connected to the outside elements 60 via a coupler 72 at one end of the flexible tube 70, i.e., a the end that becomes the outside end when connected to the outside elements 70.

Figure 2:
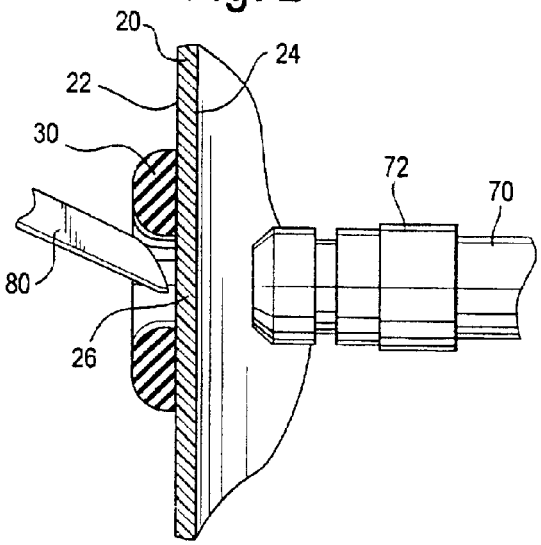
FIG. 2, on a larger scale, is a fragmentary cross-sectional detail of the elastomeric grommet, the flexible tube, and a coupler on a proximal end of the flexible tube, as illustrated before a region outlined by the elastomeric grommet is penetrated by the tube, which is preceded by the coupler. A blade is illustrated fragmentarily, which is useful to cut into said region, whereby to facilitate said region being penetrated.
Figure 3:
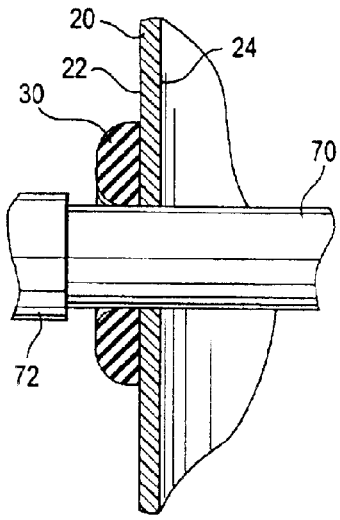
FIG. 3 is a similar detail, as illustrated after the region outlined by the elastomeric grommet has been penetrated by the flexible tube, as preceded by the coupler, the elastomeric grommet providing a fluid-tight seal around the flexible tube.

As illustrated in FIG. 2, the sheet 20 is fluid-impervious when and where not penetrated. As further illustrated in FIG. 2, it is convenient to us a blade 80 to cut into the region 26 outlined by the elastomeric grommet 30. As illustrated in FIG. 3, when the region 26 outlined by the elastomeric grommet 30 is penetrated by the flexible tube 70, as preceded by the coupler 72, the elastomeric grommet 30 stretches to enable the coupler 72 and a leading portion of the flexible tube 70 to pass through the elastomeric grommet 30, whereupon the flexible tube 70 fits tightly through the elastomeric grommet 30, which provides a fluid-impervious seal around the flexible tube 70.

Figure 4:
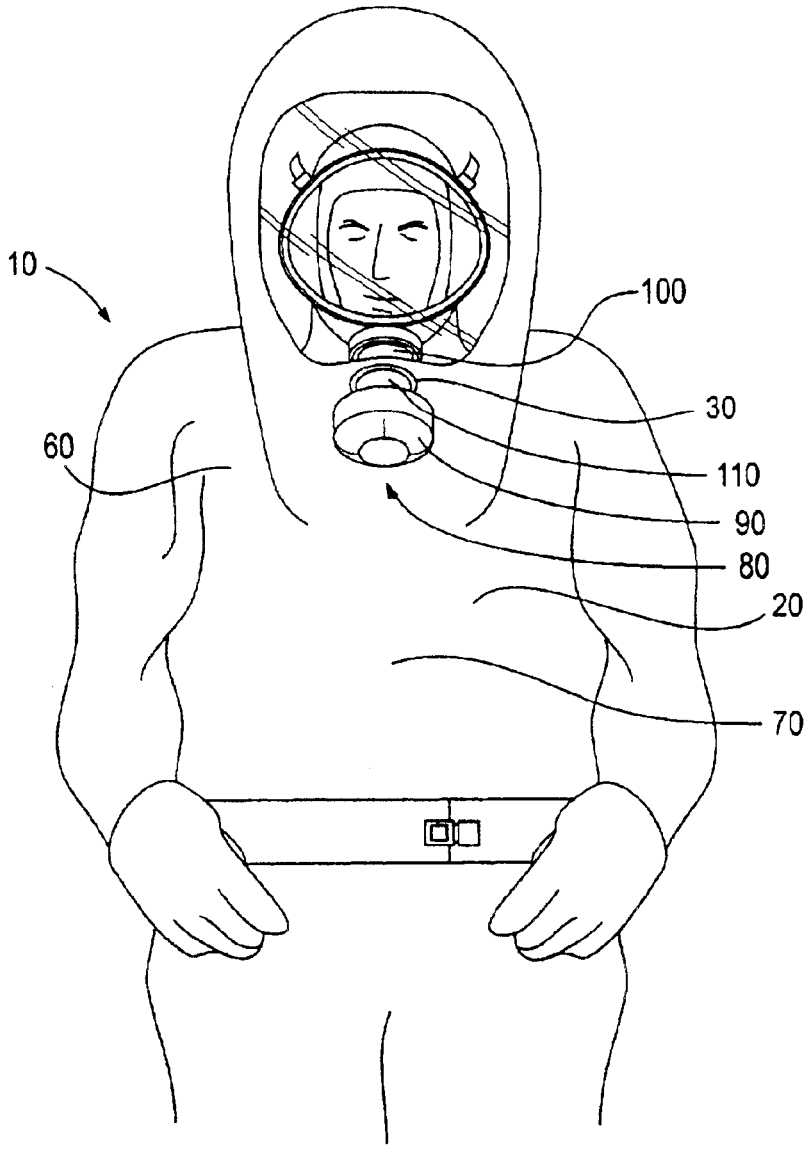
FIG. 4 is a view, which is similar to FIG. 1, except that FIG. 4 illustrates that this invention can be advantageously used with an air-filtering apparatus, as well as with a breathing apparatus.

As illustrated in FIG. 4, the elastomeric grommet 30 can be advantageously used with an air-filtering apparatus 80 comprising elements 90 inside the protective garment 10, elements 100 outside the protective garment 10 and a short, rigid tube 110, which is similar to the aforesaid tube 70, except for its length and its rigidity, and which connects the inside elements 90 and the outside elements 100.

What is claimed is:

1. A sheet having two expansive surfaces and being fluid-impervious where not penetrated, a elastomeric grommet adhering to one of the expansive surfaces of the sheet but not penetrating the sheet, the elastomeric grommet outlining a region on the sheet, wherein the region outlined by the elastomeric grommet is fluid-impervious before being penetrated and wherein the elastomeric grommet is adapted, if an object penetrates the sheet and fits tightly through the elastomeric grommet, to provide a fluid-impervious seal around the object.

2. The sheet of claim 1, as combined with an object penetrating the region outlined by the elastomeric grommet and fitting tightly through the elastomeric grommet, which provides a fluid-impervious seal around the object.

3. For a hazardous environment, a protective garment having the sheet of claim 1, as combined with a breathing or air-filtering apparatus comprising elements inside the protective garment, elements outside the protective garment, and a tube connecting the inside and outside elements, penetrating the region outlined by the elastomeric grommet, and fitting tightly through the elastomeric grommet, which provides a fluid-impervious seal around the tube.

* * * * *